US008985179B2

(12) United States Patent
Steffen et al.

(10) Patent No.: US 8,985,179 B2
(45) Date of Patent: Mar. 24, 2015

(54) SYSTEM FOR STABILIZING THE TOP LAMELLA AGAINST WIND LOAD BY USING A LINEAR CHAIN

(75) Inventors: Meinolf Steffen, Paderborn (DE); Holger Siewert, Rheda-Wiedenbrueck (DE); Friedhelm Frede, Erwitte (DE)

(73) Assignee: Assa Abloy Entrance Systems AB, Landskrona (SE)

( * ) Notice: Subject to any disclaimer, the term of this patent is extended or adjusted under 35 U.S.C. 154(b) by 1245 days.

(21) Appl. No.: 12/567,351

(22) Filed: Sep. 25, 2009

(65) Prior Publication Data

US 2011/0073261 A1 Mar. 31, 2011

(51) Int. Cl.

| | |
|---|---|
| ***E06B 9/08*** | (2006.01) |
| ***E05D 15/26*** | (2006.01) |
| ***E05D 15/00*** | (2006.01) |
| ***E06B 9/171*** | (2006.01) |
| *E06B 9/15* | (2006.01) |

(52) U.S. Cl.

CPC .. *E06B 9/171* (2013.01); *E06B 9/15* (2013.01)

USPC ..... 160/133; 160/209

(58) Field of Classification Search

CPC ..... E05D 15/24; E05D 15/165; E06B 9/15; E06B 9/17

USPC ..... 160/121.1, 133, 181, 201, 209, DIG. 15, 160/23.1, 235, 238, 291, 293.1, 300, 303, 160/32, 33, 66, 67; 242/421.9, 376, 407, 242/579

See application file for complete search history.

(56) References Cited

U.S. PATENT DOCUMENTS

| | | | | |
|---|---|---|---|---|
| 2,349,702 | A * | 5/1944 | Campion | 160/133 |
| 5,253,694 | A | 10/1993 | Bernardo | |
| 5,394,924 | A | 3/1995 | Rejc | |
| 5,484,007 | A | 1/1996 | Rejc | |
| 5,488,982 | A | 2/1996 | Rejc | |
| 5,613,539 | A * | 3/1997 | Kraler | 160/32 |
| 5,657,805 | A | 8/1997 | Magro | |
| 5,848,631 | A | 12/1998 | DeGiovanni et al. | |
| 6,068,040 | A | 5/2000 | Magro et al. | |
| 6,089,305 | A | 7/2000 | Gruben et al. | |
| 6,152,207 | A | 11/2000 | Varley | |
| 6,260,601 | B1 | 7/2001 | Thomas | |
| 6,374,551 | B1 | 4/2002 | Boilen et al. | |

(Continued)

FOREIGN PATENT DOCUMENTS

| | | |
|---|---|---|
| EP | 1028224 A | 8/2000 |
| EP | 2028338 A | 2/2009 |
| EP | 2037078 A | 3/2009 |

OTHER PUBLICATIONS

International Search Report and Written Opinion issued by European Patent Office for corresponding international application PCT/US2010/049817 mailed Jan. 11, 2011.

*Primary Examiner* — Katherine Mitchell
*Assistant Examiner* — Jeremy Ramsey
(74) *Attorney, Agent, or Firm* — Frommer Lawrence & Haug LLP; Ronald R. Santucci

(57) ABSTRACT

A mechanical link is provided to lessen or eliminate air infiltration between a topmost lamella of a rollup door and the lintel of the doorway. The link is deployed in an unfolded configuration to support the topmost lamella against deflection caused by application of a force perpendicular to the plane of the door. The link components are folded into a storage position upon rolling up of the door upon a series of take-up discs.

10 Claims, 5 Drawing Sheets

(56) References Cited

U.S. PATENT DOCUMENTS

| | | | | |
|---|---|---|---|---|
| 6,951,236 | B2 | 10/2005 | Schlater et al. | |
| 7,252,133 | B2 | 8/2007 | Bengtsson et al. | |
| 7,464,743 | B1 | 12/2008 | Berger, Jr. | |
| 7,516,770 | B2 | 4/2009 | Jerry | |
| 8,011,414 | B2 * | 9/2011 | Levy et al. | 160/133 |
| 2006/0090860 | A1 * | 5/2006 | Corboy | 160/133 |
| 2007/0062650 | A1 | 3/2007 | Rejc | |
| 2007/0181264 | A1 | 8/2007 | Frede | |
| 2007/0284053 | A1 | 12/2007 | Mullet et al. | |
| 2008/0041536 | A1 | 2/2008 | Bengtsson et al. | |

* cited by examiner

SYSTEM FOR STABILIZING THE TOP LAMELLA AGAINST WIND LOAD BY USING A LINEAR CHAIN

FIELD OF THE INVENTION

This invention generally relates to articulated rollup coverings comprised of lamella or door leaf. In particular, the invention relates to a system for stabilizing the topmost lamella against an externally applied load. More particularly, the invention relates to a system for stabilizing the topmost lamella against out-of-plane deflection resulting from a wind load.

BACKGROUND OF THE INVENTION

The invention disclosed herein relates to devices that assist in stabilizing door leaf or lamellae in a vertical running door against wind load applied to a side of the door.

Rollup doors comprising door leaf or lamella (hereinafter "lamella") are typically supported at the left and right edges of the doorway to be covered by rigid door guides. The rigid door guides allow vertical movement of the lamella and support the left and right edge portions of the lamella against deflection perpendicular to the plane of the door or the plane of the lamella. The lamella are typically operatively connected between the left and right end portions to allow for rotation about an axis along the length of the lamella to allow for flexibility in the rollup direction. The operative connection between adjacent lamella is configured to resist separation between adjacent lamella if a lamella or lamellae is subjected to a perpendicular force. Adjacent connected lamella provide support against separation and deflection when the door is subject to a perpendicular load, such as a wind load.

Rollup doors comprised of lamellae are often used to provide a movable covering for an opening in a building or structure. When unrolled from a take-up drum to cover the opening, that is, when in the closed position, the bottom lamella typically rests against the bottom of the opening. Successive lamellae in the vertical direction abut the layer of lamellae directly below and above. The operative connection between adjacent lamellae maintain proper vertical alignment. Each lamella from the bottom of the door to the penultimate lamella at the top are supported at the left and right by the rigid door guide and at least by an adjacent lamella from above. The topmost lamella, however, is only supported in the left and right door guides and by the lamella below, leaving the top edge unsupported from above.

Under most conditions, the topmost lamella is supported on the left and right edges by the rigid door guide and below by the adjacent lamella. Normally the top edge of the topmost lamella rests against the lintel, the architectural member defining the top of the doorway. If the topmost lamella is subjected to a perpendicular load, as from the wind, no structure is available to prevent it from deflection, particularly at the top edge. In many instances the deflection provides a site for air infiltration from one side of the door to the other, with the concomitant dirt, dust, and other contaminants.

The top edge of the topmost lamella cannot be permanently sealed against the lintel, as this would prevent the door from rolling up to open the doorway. A method or system for providing adequate support for the topmost lamella when the door is closed, while allowing the door comprised of lamella to roll up, is needed.

SUMMARY OF THE INVENTION

Flexible rollup doors comprised of lamella or door leaf (hereinafter "lamella") are subject to wind loads, particularly when the rollup doors are used to cover an opening between the outside environment and the interior space of a building. In some situations, doors may be subject to pressure variations similar to wind loads when such doors are used to separate interior spaces. A pressure or wind load applied to the top portion of the door can deflect at least the mid portion of the topmost lamella away from an abutting or adjacent structure, such as the lintel. This may cause an unacceptable air infiltration between the lamella and the lintel. Common sealing techniques are not appropriate for such doors because of the need for the door to roll up at least part way onto a drum, or series of take-up discs, located above the doorway in order to uncover the doorway.

According to some embodiments of the invention, a door comprised of lamellae is provided with a system to lessen, or eliminate, the gap formed between the topmost lamella and the lintel in the middle portion of the top lamella when the lamella is subject to a perpendicular force or load, such as a wind load. According to some embodiments of the invention, one end of a series of mechanical links, or a type of linear chain, is fixed to the top lamella with a bracket. The second end of the linear chain is clamped to a rotating portion of a rollup device onto which the lamellae roll to open the doorway or opening and from which the lamellae unroll to cover the doorway or opening. In some embodiments of the invention, the rollup device includes take-up discs spaced apart along the length of a shaft powered for rotation in a first direction and a second direction. In some embodiments of the invention, the take-up discs are spiral discs. Between adjacent take-up discs, sufficient space is provided for the linear chain to reside in a storage position.

For purposes of this disclosure, the door system will have an outside which may correspond to the exterior of a building or structure. The surfaces of lamellae forming the outside of the door will be referred to as outside or outer surfaces of the lamellae. The inside of the door system, or the inside or inner surface of the lamellae comprising the door, will be used to reference the side of the door on which the roll up system, including the shaft or barrel and the take-up discs are located.

Also for purposes of this disclosure, the doorway is understood to lie in a generally vertical plane having a width or longitudinal dimension and a height or vertical dimension. The lamellae or door leaf, or door panels comprising the rollup door are also understood to be generally planar and have a width substantially the same as the width of the door opening. The height of the lamellae is chosen to allow smooth take-up and lowering of the door upon the drum or take-up discs. In many cases, this is substantially less than the height of the door. The plane of the lamellae as used herein is the plane of the doorway.

Wind loads or other similarly applied forces cause out of plane deflection of the lamellae, that is, the lamellae deflect in the direction of the force. For purposes of this disclosure, out of plane deflection of the lamellae as a result of wind loads may be referred to as transverse deflections, as in transverse to the doorway.

According to embodiments of the invention, an elongate bracket is affixed to the inside surface of the top lamella of a conventional articulated rollup door with a top end of the bracket extending beyond the top edge of the topmost lamella. At a point spaced from the top end of the bracket along the length of the bracket, a pivot hole or passage is provided transverse to the longitudinal axis of the bracket with the pivot hole parallel to the face of the lamellae in the longitudinal direction of the lamella.

According to embodiments of the invention, a generally linear elongate middle chain link is provided with a pivot hole spaced apart from a first end and a second pivot hole at or near the second end. In some embodiments, a generally linear chain link having a pivot hole in each end links the bracket and the middle chain link together through a pinned joint for rotation in a generally vertical plane.

In some embodiments, at least one of the bracket and the middle chain link include cooperating structures to limit the amount of rotation of the chain link and the middle chain link. According to some embodiments, the chain link and the middle chain link are restricted from rotation in a first direction in which the longitudinal axes of the bracket, the chain link, and the middle chain link are coincident or coaxial and parallel to the inside surface of the lamellae. Limits to the rotation of the chain link and middle chain link in a second direction will become obvious in the discussion below.

In some embodiments, the second end of the middle chain link is pinned through the second hole with a first end of a generally linear elongate swivel arm. A second end of the swivel arm is pinned to a clamp, the clamp adjustable in rotational position on the shaft supporting the take-up discs. Rotation of the swivel arm about the pinned connection with the middle chain link is limited by a stopper structure affixed to the swivel arm and located within the angle formed between the swivel arm and the middle chain link.

According to some embodiments, a resilient, tension providing element, for example, a spring, is provided between a portion of the clamp and the pinned joint between the chain link and the middle chain link, providing a tension force to the joint in the direction of the clamp.

In some applications of the invention, more than one stabilizing system can be used along the length of the uppermost lamellae in an articulated rollup door. The inventive system folds or collapses as the winding up of the door is begun. The folded system is configured to fit between the take-up discs along the length of the shaft and to fit within the diameter provided by the outer circumference of the take-up disc. In other applications, a spiral disc, a round disc, a multi-faceted disc, or other appropriately shaped disc may be used to support the lamellae when wound up. With the take-up disc configurations, the inventive system can fold or collapse when the door is wound up, fitting into the volume of space between adjacent discs and the outer diameter of the discs. In applications using a drum, the inventive system can be used provided adequate volume and access to the volume is available within the drum to accept the folded system during wind-up.

According to some embodiments, as the lamella approach the fully unwound position, thereby covering the doorway, the bracket and the swivel arm cause the chain link and the middle chain link align with the bracket in a position generally parallel to the lamellae in which the axes of the bracket, chain link, and middle chain link are in coaxial alignment. This is the deployed position for the stabilizing system. Wind load or other forces acting on the outside of the door are met by the resistive force of the stabilizing system. As the lamella reacts to the force applied to the outside of the door, the rotation resistant structures on the middle chain link and the bracket cooperate with the chain link to prevent inward deflection of the topmost lamella. The swivel arm is substantially perpendicular to the aligned axes of the bracket, chain link and middle chain link transmits the applied wind load to the drum shaft providing a rigid mechanism to resist the externally applied force. In some embodiments, the swivel arm transmits the applied wind load through the center of rotation of the shaft.

When winding up of the door is initiated, the torque applied by the rotating shaft allows the pinned joints to fold in the direction of the curvature of the take-up discs. The lamellae are supported upon the outer surface of the discs and the spring provides a tension to the first end of the middle chain link to pull the components into the cavity within the discs.

BRIEF DESCRIPTION OF THE DRAWINGS

The following detailed description, given by way of example and not intended to limit the invention to the disclosed details, is made in conjunction with the accompanying drawings, in which like references denote like or similar elements and parts, and in which.

DETAILED DESCRIPTION OF PREFERRED EMBODIMENTS

Embodiments of the invention are described below with reference to the accompanying drawings which depict embodiments of the invention. However, it is to be understood that application of the invention encompasses other uses for the invention in applications involving rollup coverings. Also, the invention is not limited to the depicted embodiments and the details thereof, which are provided for purposes of illustration and not limitation.

Figure 1:
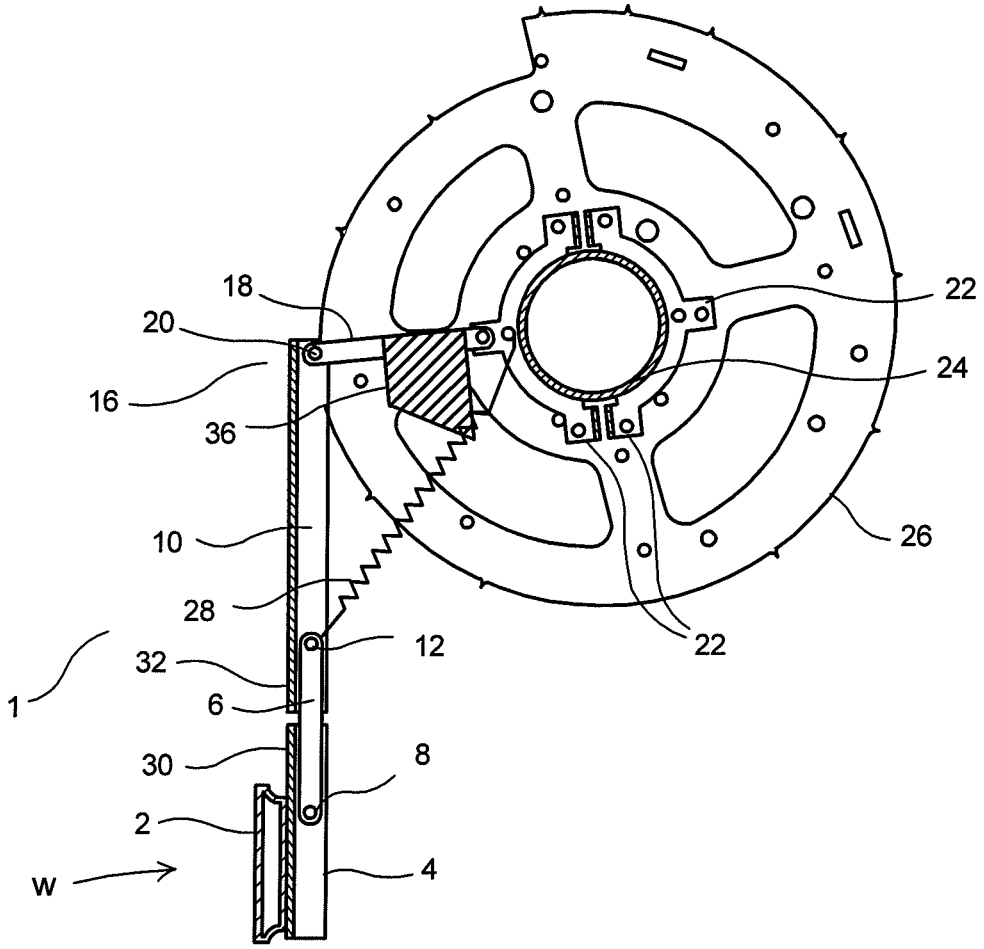
FIG. 1 is a partial cross sectional side view of the stabilizing system of an embodiment of the current invention with the door in a closed position.
Figure 2:
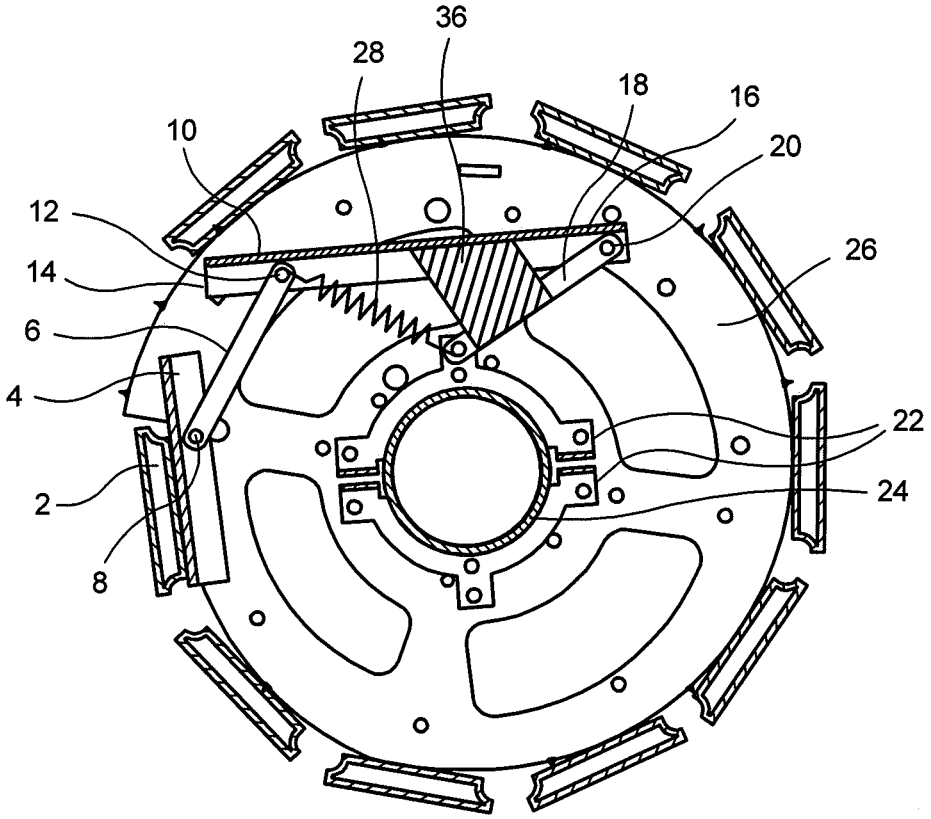
FIG. 2 is a partial cross sectional side view of the stabilizing system of an embodiment of the current invention with the door wound upon the spiral disc.
Figure 3:
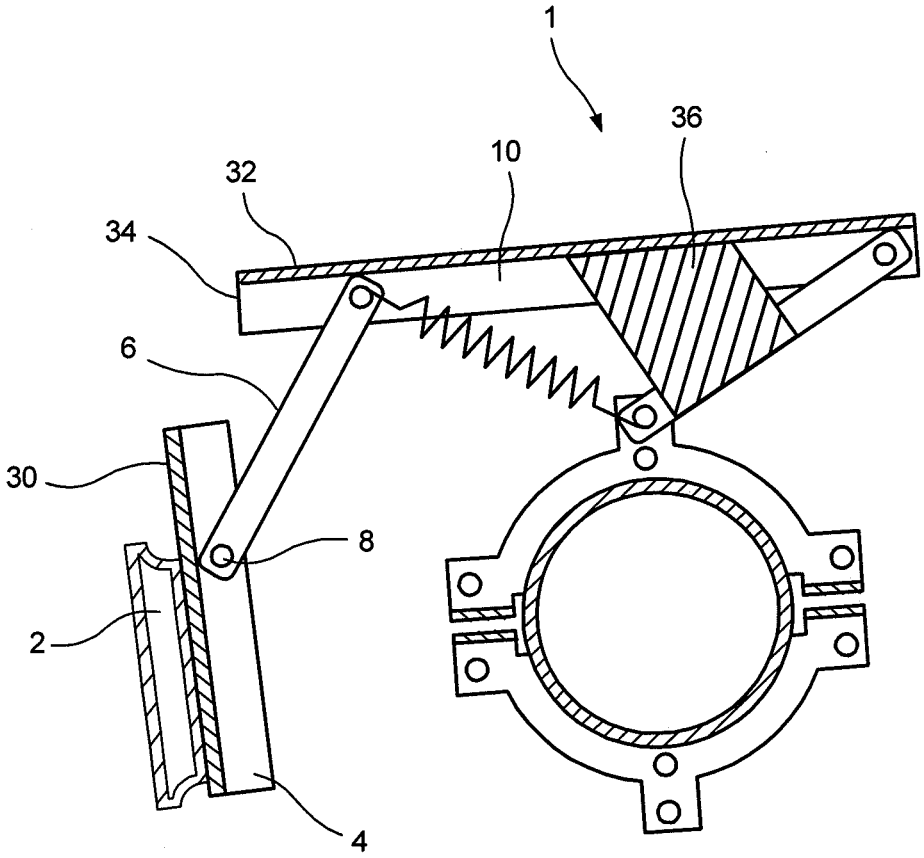
FIG. 3 is an enlarged view of FIG. 2 showing only the stabilizing link according to an embodiment of the embodiment.
Figure 4:
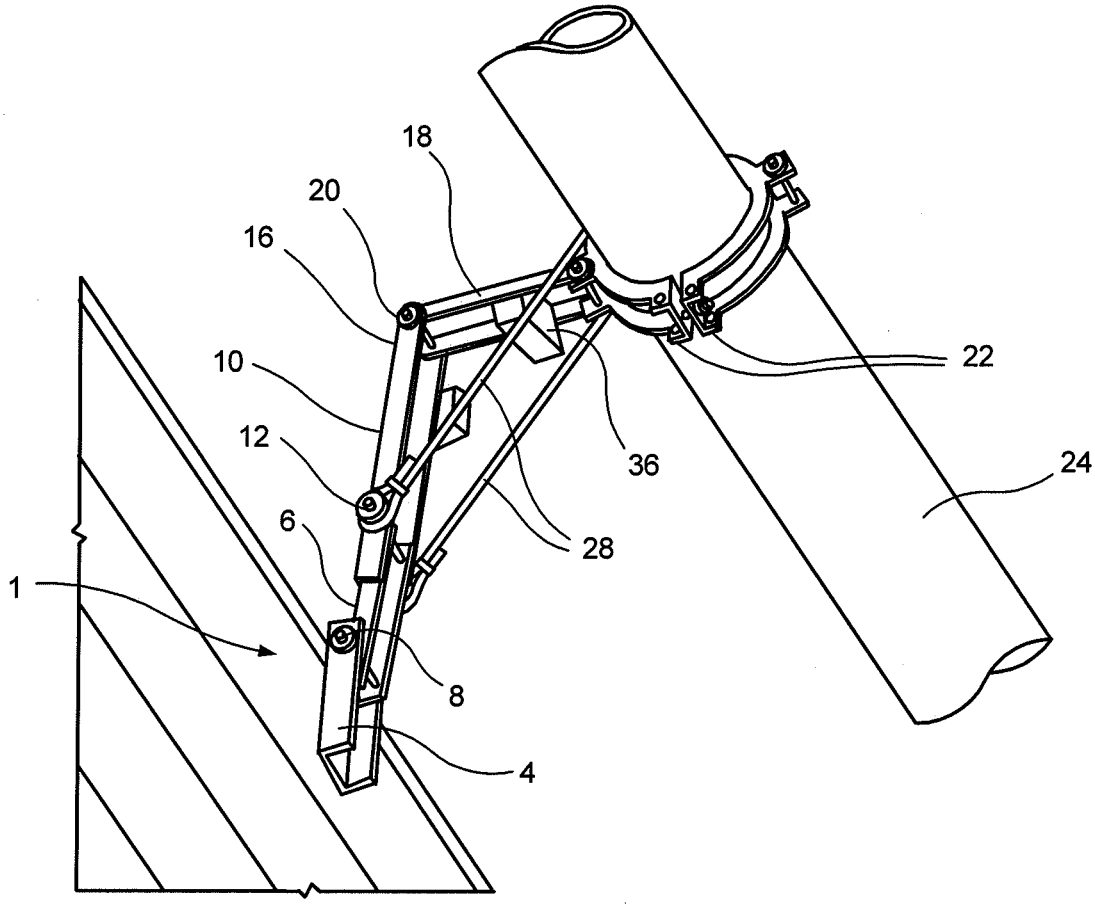
FIG. 4 is a perspective view of the stabilizing system according to an embodiment of the invention.

FIGS. 1 and 4 illustrate the system for stabilizing the topmost lamella of a rollup door in the unwound position. Topmost lamella 2 is in a position corresponding to a closed or unwound rollup door in position to cover the doorway. Generally linear, U-shaped and elongate bracket 4 is affixed to the inside surface of the topmost lamella 2 with the open side facing away from the lamella 2 and the longitudinal axis of bracket 4 generally perpendicular to the top and bottom edges of lamella 2. For clarity, FIGS. 1-3 illustrate U-shaped bracket 4 in cross section taken along a longitudinal line down the center thereof mirror image of that shown. As can be seen in FIGS. 1 and 2, bracket 4 extends above the uppermost edge of lamella 2.

Generally linear and elongate chain link 6 is pivotally attached, as with a pin or hinge pin, to bracket 4 at first joint 8. Chain link 6 may be U-shaped as shown in FIG. 4, or may be a rectangular tube, or a solid link. As best illustrated in FIGS. 1 and 4, chain link 6 is positioned substantially within the cavity formed by U-shaped bracket 4. As illustrated in FIG. 2, the pivot point of first joint 8 on bracket 4 is spaced away from the uppermost end of the bracket.

Chain link 6 is also pivotally attached in the same or similar manner to elongate linear middle chain link 10 at second hinge point 12. Middle chain link 10 is U-shaped, similarly sized and generally aligned with bracket 4 with the open side of each similarly oriented. For clarity, FIGS. 1-3 illustrate middle chain link 10 in cross section taken along a longitudinal line down the center thereof. Chain link 6 is positioned substantially within the cavity formed by U-shaped middle chain link 10 as best illustrated. As illustrated in FIG. 2, the pivot point of second joint 12 on middle chain link 10 is spaced away from the first end 14 of the middle chain link 10.

Second end 16 of middle chain link 10 is pivotally attached to an end of linear elongate rigid swivel arm 18 at third joint 20. The other end of swivel arm 18 is pivotally attached to clamp 22 selectively positionable angularly and linearly on shaft 24.

Cooperating structures on the bracket 4 and middle chain link 10 limit the rotation of chain link 6 and middle chain link 10 about first and second joints 8 and 12. As can be seen in FIGS. 1 and 3, wall segment 30 (shown in cross section) of bracket 4 limits the rotation of chain link 6 about joint 8 in the counterclockwise direction as shown in the figures. In other embodiments, at least part of the edge of bracket 4 adjacent to lamella 2 has a lip, tab, or protrusion 30, similar to wall segment 30, that limits the rotation of chain link 6 about joint 8 in a counterclockwise direction. In FIG. 1, chain link 6 is abutting the wall segment 30 on bracket 4 which prevents further counterclockwise rotation of chain link 6 about joint 8.

Likewise, middle chain link 10 has a similar wall segment 32 that limits the rotation of chain link 6 about second joint 12 in a clockwise direction as shown in the figures. In other embodiments, at least part of the edge of middle chain link 10 has a lip, tab or protrusion, similar to wall segment 32, along at least part of edge 34 that limits the rotation of chain link 6 about second joint 12. In FIG. 1, chain link 6 is abutting against wall segment 32 of middle chain link 10 which prevents further clockwise rotation of chain link 6 about joint 12.

In some embodiments of the invention, a cooperating structure on at least one of the bracket 4 and middle chain link 10 is sufficient to limit the rotation of the chain link about a pinned joint 8 or 12.

Swivel arm 18 as shown in FIG. 1 supports second end 16 of middle chain link 10 from horizontal movement. The swivel arm 18 is substantially perpendicular to at least the middle chain link 10 when the topmost lamella 2 is in position against the doorway lintel (not shown). Inward deflection of lamella 2 due to wind load W or other similarly acting force can be resisted.

As a force W is applied to the outside of lamella 2, the lamella deflects in response. The left and right ends of the lamellae are supported, for example, in rigid door guides (not shown) as discussed above. The left and right ends of topmost lamella 2 are supported by the door guides, and the lower edge is supported by the top edge of the next lower lamella. The top edge of topmost lamella 2, particularly in a middle portion of the lamella, will deflect inward against a force W applied to the outer surface of the lamellae. The stabilization system according to the invention prevents, or substantially prevents, such inward deflection.

An inward deflection of lamella 2 in response to force W will have a deflection component in the horizontal direction, and may have a component in the vertical direction as a result of varying components of W or because lamella 2 is restricted from freely deflecting by the next lower lamella (not shown). In either case, lamella 2, and bracket 4 affixed thereto, will be urged to deflect inward (to the right as illustrated) in response to force W. As bracket 4 is urged inward, and with it joint 8, chain link 6 will be urged to rotate counterclockwise. However, wall segment 30 of bracket 4 resists the attempted deflection. As chain link 6 is urged to rotate counterclockwise, at least a portion of the link abuts wall segment 30 preventing further counterclockwise rotation of link 6. Lamella 2, bracket 4, and chain link 6 are urged to deflect together inwardly in response to load W, in a vertical or nearly vertically alignment.

Inward deflection of chain link 6, restricted from counterclockwise rotation about joint 8, tends to create a clockwise rotation of chain link 6 about joint 12. Wall segment 32 of middle link 10 resists clockwise rotation of chain link 6 about joint 12. As chain link 6 is urged to rotate clockwise, at least a portion of the link abuts wall segment 32 preventing further clockwise rotation of link 6. With clockwise rotation about joint 12 limited, lamella 2, bracket 4, chain link 6 and middle chain link 10 are urged to deflect together inwardly in response to load W, in vertical or nearly vertical alignment.

Accordingly, the force W is effectively transferred from the topmost lamella 2 through bracket 4, chain link 6, and middle chain link 10 to rigid swivel arm 18 through joint 20. As illustrated in FIG. 1, swivel arm 18 is horizontally orientated when the door is in a closed position. Swivel arm 18 is also perpendicular or substantially perpendicular to at least middle chain link 10. Force W is transferred to the rigid swivel arm 18 to clamp 22 secured against rotation to shaft 24. Shaft 24 is held against rotation by drive and brake means (not shown), and against displacement by associated mounting structures (not shown).

Accordingly, FIG. 1 illustrates the stabilizing system 1 in deployed condition to provide rigid support for the topmost lamella 2 against out of plane deflection.

Figure 5:
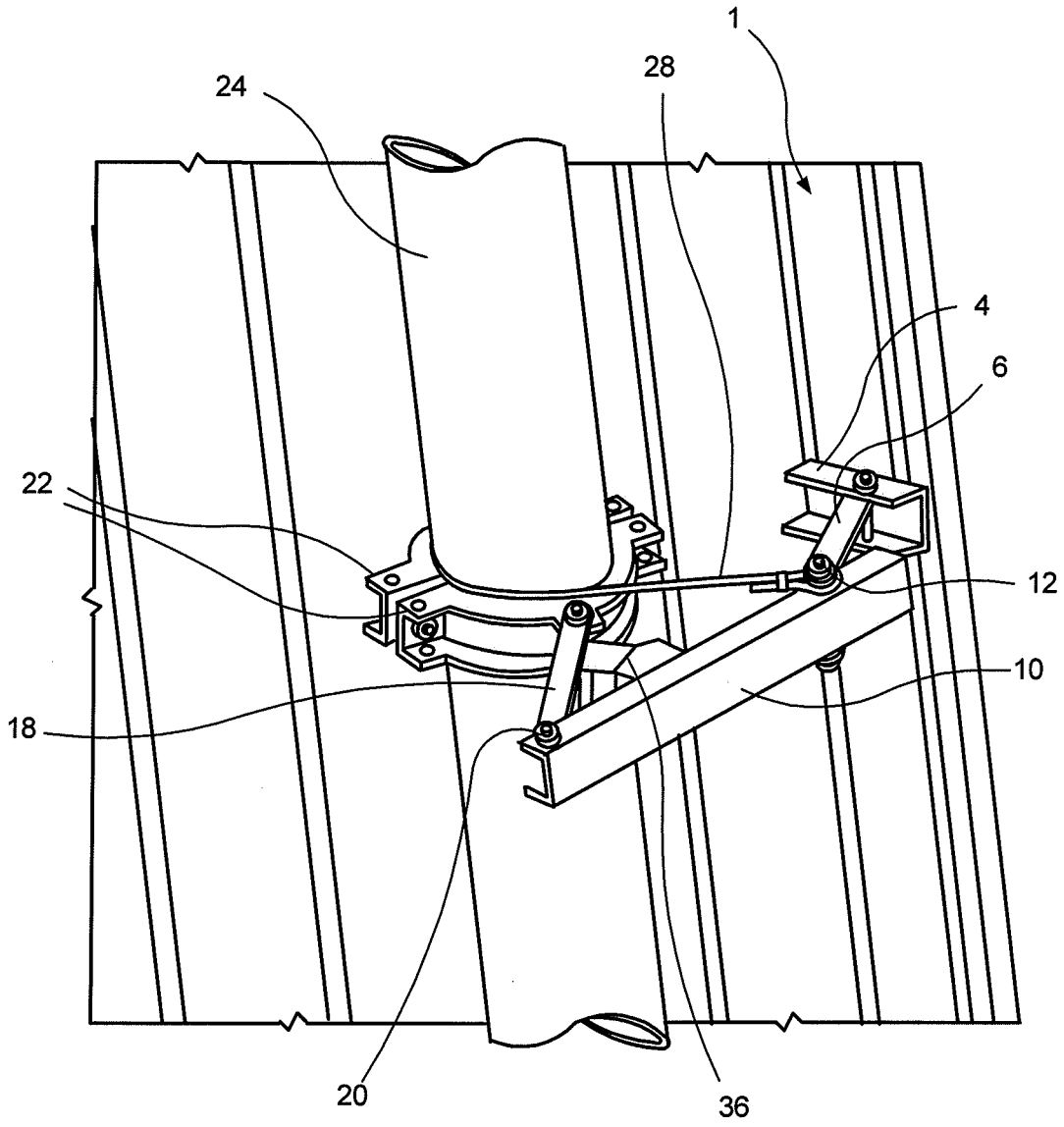
FIG. 5 is a perspective view of the stabilizing system according to an embodiment of the invention in a folded position.

As shown in FIG. 2, upon lifting of the lamellae when opening the door, lamella 2 conforms to the curvature of spiral disc 26 and bracket 4 is resides in the void between the disc 26 and shaft 24. (See also FIG. 5 which shows the stabilizing system 1 in the folded position). Chain link 6 rotates clockwise about joint 8 and middle chain link 10 rotates clockwise about joint 12 to fit within the open space between adjacent spiral discs 26 and within the outer perimeter of the spiral discs 26. Resilient biasing member 28 is operatively attached to joint 12 and an appropriate point on clamp 22. The resilient biasing member 28 urges middle chain link 10 and swivel arm 18 into close contact, separated by stopper 36, maintaining correct position of the stabilizing device within the space provided.

Although preferred embodiments of the present invention and modifications thereof have been described in detail herein, it is to be understood that this invention is not limited to this precise embodiment and modifications, and that other modifications and variations may be effected by one skilled in the art without departing from the spirit and scope of the invention as defined by the appended claims.

We claim:

1. In a vertical running door system comprising lamellae, a shaft driven in rotation, and a take-up means, a stabilizing system is provided, the stabilizing system comprising:

an elongate bracket affixed to a topmost lamella of a door, the elongate bracket being elongate in a vertical direction of the door and extending above an uppermost edge of the topmost lamella when the door is in an unwound position;

an elongate chain link pivotally attached to form a first joint at a first end of the elongate chain link to a portion of the elongate bracket;

an elongate middle chain link pivotally attached to form a second joint at a first end of the elongate middle chain link to a second end of the elongate chain link;

an elongate swivel arm pivotally attached to form a third joint at a first end of the elongate swivel arm to a second end of the middle chain link and a second end of the elongate swivel arm pivotally attached to a clamp wherein, in response to a force transverse to the vertical direction of the door, the bracket restricts rotation of the elongate chain link in a first direction about the first joint and the middle chain link restricts rotation of the elongate chain link in a second direction about the second joint to stabilize cooperatively the topmost lamella from transverse deflection.

2. The stabilizing system of claim 1 wherein the take-up means are spiral discs.

3. The stabilizing system of claim 1 wherein the cooperative engagement comprises at least one of a lip on the bracket limiting rotation of the chain link about a pinned joint in a first direction and a lip on the middle chain link limiting rotation of the chain link about a pinned joint in a second direction.

4. The stabilizing system of claim 1 wherein the clamp is adjustably fixed in at least one of radial position on the shaft and longitudinal position along the shaft.

5. The stabilizing system of claim 2 wherein the cooperative engagement of the bracket, chain link, and middle chain link occurs as the shaft is driven to a position at which the lamellae are fully unwound from the spiral discs.

6. The stabilizing system of claim i wherein the cooperative engagement of the bracket, chain link, and middle chain link occurs when a longitudinal axes of the bracket, a longitudinal axes of the chain link, and a longitudinal axes of the middle chain link are substantially coaxially aligned.

7. The stabilizing system of claim 1 wherein, when the bracket, chain link, and middle chain link are in cooperative engagement, the swivel arm is substantially perpendicular to an aligned axes of the bracket, chain link, and middle chain link.

8. The stabilizing system of claim 2 wherein powered rotation of the shaft to raise the lamellae causes the first joint, second joint, and third joint to fold into a storage position within the space defined by an outer perimeter of the spiral discs.

9. The stabilizing system according to claim 8 further comprising a resilient biasing device operatively attached to the second joint and a point on the clamp, the resilient biasing device urging the middle chain link to pivot about the third joint in the storage position.

10. The stabilizing system according to claim 9 further comprising a resilient stopper affixed to the swivel arm positioned to engage the middle chain link when the middle chain link pivots about the third joint in the storage position.

* * * * *